US005791504A

United States Patent [19]

Hofmann et al.

[11] Patent Number: 5,791,504

[45] Date of Patent: Aug. 11, 1998

[54] CHILD RESISTANT CONTAINER

[75] Inventors: Richard W. Hofmann, Chicago; Alex J. Kutaj, Vernon Hills, both of Ill.

[73] Assignee: Magenta Corporation, Chicago, Ill.

[21] Appl. No.: 699,475

[22] Filed: Aug. 19, 1996

[51] Int. Cl.[6] ..... B65D 50/10; B65D 50/06

[52] U.S. Cl. ..... 215/223; 215/225; 215/274; 215/321

[58] Field of Search ..... 215/206, 208, 215/213, 214, 224, 223, 225, 228, 274, 276, 317, 318, 321; 220/212, 319, 293, 296, 298, 780, 8, 784

[56] References Cited

U.S. PATENT DOCUMENTS

| | | | |
|---|---|---|---|
| 3,402,842 | 9/1968 | Millian | 215/223 X |
| 3,450,290 | 6/1969 | Turner | 215/224 X |
| 3,587,896 | 6/1971 | Graff | 215/206 |
| 3,782,574 | 1/1974 | Rumble | 215/206 X |
| 3,869,057 | 3/1975 | Miller | 215/317 X |
| 3,896,958 | 7/1975 | Robbins et al. | 215/224 X |
| 3,905,509 | 9/1975 | Markowitz | 215/274 X |
| 4,482,068 | 11/1984 | Agbay et al. | 215/206 X |
| 4,613,051 | 9/1986 | Swartzbaugh | 215/225 |
| 5,397,008 | 3/1995 | Glynn . | |
| 5,462,181 | 10/1995 | Glynn | 215/274 X |

*Primary Examiner*—Allan W. Shoap
*Assistant Examiner*—Nathan Newhouse
*Attorney, Agent, or Firm*—Laff, Whitesel, Conte & Saret, Ltd.; Robert F. I. Conte

[57] ABSTRACT

A child resistant container having a container body, a ring and closure. The container body has an annular guide disposed on its neck's outer surface. The ring has an annular support disposed on its inner surface. The ring rotatably couples to the container body by sliding the ring over the container body's neck and positioning the support inside the guide. The ring has an annular protrusion on its outer surface. The protrusion is divided into segments. The closure has an annular protrusion on its wall's inner surface. The closure's protrusion is divided into segments. The closure is snapped on the ring and retained on the ring via an interlocking of the segments. The closure is removed from the ring by aligning the closure segments in a position so they will pass through the gaps in the ring protrusion.

10 Claims, 5 Drawing Sheets

CHILD RESISTANT CONTAINER

FIELD OF INVENTION

This invention relates to a child resistant container and more particularly to a container having a container body, a closure, and a ring. The ring is rotatably coupled to the container body and the closure is coupled to the ring.

BACKGROUND OF INVENTION

Young children have a tendency to get into containers which contain dangerous substances. Therefore, industry has developed child resistant safety containers to prevent children from getting into containers having dangerous substances. The majority of safety containers operate by increasing or complicating the steps required to remove a closure from a container body.

There are numerous types of safety containers. Some known safety containers utilize a container, a ring rotatably coupled to the container, and a cap which couples to the ring. In these devices the ring has a track. The ring has a ledge with cut-outs. The cap has protrusions.

The ring's track rotatably couples to the container. The ring's ledge and the cap's protrusions interlock with each other to lock the cap to the ring. The cap is removed from the ring by moving the cap's protrusions through the ring's cut-outs. These devices have some drawbacks. For instance, the cap and ring do not reliably rotate in unison relative to each other. The non-unison rotation increases chances of an accidental alignment of the cap and ring. Further, the cap can be too easily pried off the ring without proper alignment. The ring can also be too easily pried off the container. My invention helps to solve the above problems.

My safety container has a container body, a closure and a ring. The container body has an annular guide and the ring has an annular support. The ring is rotatably coupled to the container body by sliding the ring over the container body's neck and positioning the support inside the guide.

My closure has segments which extend radially inward along the cap's inner surface. My ring has segments which extend radially outward along the ring's outer surface. The ring and closure segments interlock with each other, thereby locking the cap to the ring when the closure is snapped on the ring.

The segment surfaces improve unison rotation of the cap relative to the ring. The shape and spacing of my segments also improves the locking of the cap to the ring.

My ring support's unique design improves unison rotation of the cap relative to the ring.

Further, the locus of my ring's horizontal support inhibits a prying off of the ring from the container body.

SUMMARY

In one embodiment of my invention I provide a container which has a container body. The container body has a closed end, and a neck portion with an open end. The open end is opposite the closed end.

The neck portion has a means to receive and rotatably hold a ring thereon. The rotatable means maintains the ring on the neck portion during use of the container. The rotatable means allows the ring to rotate about the axis of and relative to the neck portion.

The ring is substantially cylindrical. The ring has an upper and a lower concentric cylindrical portion. The upper ring portion extends concentrically upwardly from the lower ring portion.

The ring has an annular upper ledge surface. The annular upper ledge surface is between a top surface of the upper ring portion and a bottom surface of the lower ring portion.

An annular ring protrusion extends radially outwardly from an outer surface of the upper ring portion. The ring protrusion is divided into a plurality of at least six ring segments spaced a predetermined distance part to provide at least six ring segment gaps.

A snap-on closure is sized for coupling to the upper ring portion. The closure has an annular closure protrusion extending radially inwardly from an inner surface of the closure. The annular protrusion is divided into a plurality of at least six closure segments spaced a predetermined distance apart to provide at least six closure segment gaps.

The ring segments and closure segments are sized so that the closure will snap on the upper ring portion with said closure segments being in a position below the ring segments when the closure is snapped on the ring. The closure has an open end and a side wall. The side wall has an end wall. The end wall is sized to contact the upper ledge surface when the closure is snapped on the ring.

The six closure segments and the six ring segments are sized and spaced from one another to provide a removal position. In the removal position the closure segments may axially pass between the ring segments. There are no more than two circumferential removal positions.

A plurality of key protrusions extends upwardly from the upper ledge surface. The end wall of the closure has a plurality of key grooves. The key grooves are adapted to receive the key protrusions when the closure is snapped onto the ring. The interaction of the key grooves and key protrusions provides simultaneous rotation of the ring and closure.

The key grooves and key protrusions are sized to permit relative rotation of the closure and the ring. The relative rotation occurs when the ring and closure are held separately and rotated relative to one another.

My invention can alternatively be described as a child resistant container which has a container body, a ring, and a closure. The container body has a means to rotatably couple a ring to said container body; said container body has a guide which forms part of said container body's rotatable means. The ring has a means to rotatably couple itself to said container body.

The ring has a support which forms a part of the ring's rotatable means. The support traverses a path along the ring's inner surface. The support is positioned on the ring to protrude underneath a portion of the container body's guide when the ring is coupled to the container body. When the ring is coupled to the container, the interaction of the guide and ring's support allows the ring to be rotatably coupled to the container body.

A protrusion is disposed on an outer surface of the ring. The protrusion traverses a path along the ring's outer surface. The protrusion has at least one gap therein. Each gap in the ring's protrusion divides the protrusion into a segment. The ring has at least one segment with a frustoconical bottom surface. The surface slopes upward from the ring's outer surface. The frustoconical bottom surface forms an angle of greater than 90° with the ring's outer surface.

The closure has a protrusion. The protrusion traverses a path along an inner surface of the closure. The protrusion has at least one gap therein. Each gap in the closure's protrusion divides the protrusion into a segment. The closure has at least one segment with a frustoconical top surface. The surface slopes downward from the closure's inner surface. The frustoconical top surface forms an angle of greater than 90° with the inner surface of the closure.

An amount of segments disposed on the closure are equal in number to an amount of gaps in the ring's protrusion. In addition, an amount of gaps in the closure's protrusion are equal in number to an amount of segments disposed on the ring.

The closure can be coupled to the ring. The coupled closure and ring have a position relative to one another so that upon uncoupling of the cap from the ring each closure segment will pass through a different one of the gaps in the ring's protrusion; and each gap in the closure's protrusion will allow passage of a different one of the ring segments.

The ring's support and ring's protrusion can additionally be described by reference to the axial spacing between the support and protrusion. The ring's support has a vertical axis which only extends its axial length. The ring's protrusion has a vertical axis which only extends its axial length. The ring protrusion can be enclosed in a plane perpendicular to the ring protrusion's vertical axis. The ring support can be enclosed in a plane perpendicular to the ring support's vertical axis. The plane enclosing the support and the plane enclosing the protrusion do not intersect.

Accordingly, the present invention has features which improve upon the prior art.

The features of my invention include a child resistant container that has segments which are spaced and shaped to improve the locking of the closure to the ring.

The features of my invention also include a child resistant safety container that has a protrusion segment and a closure segment with surfaces that improve the frictional contact between the cap's protrusion and the ring's protrusion.

The features of my invention also include a child resistant container with improved unison rotation of the cap and ring.

Other desires, results, and novel features of the present invention will become more apparent from the following drawings, detailed description, and the accompanying claims.

DETAILED DESCRIPTION

Figure 1:
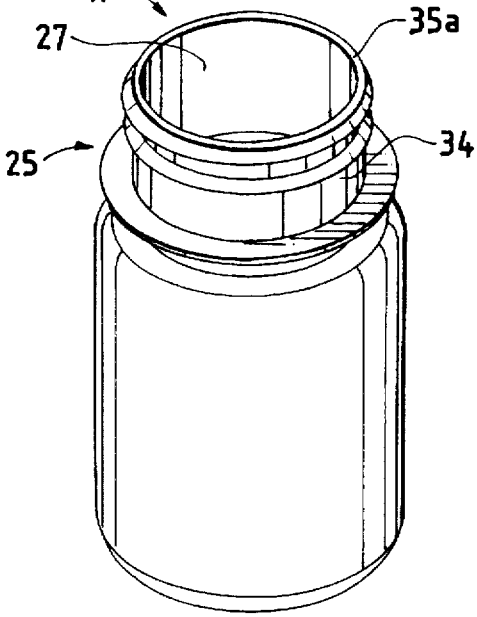
FIG. 1 is a top side perspective view of the container body.

FIGS. 1 through 12 show examples of my invention. The invention comprises a container body (17) (FIGS. 1–3), a ring/collar (19) (FIGS. 4–7*c*), and a closure (21) (FIGS. 8–11). The container body, closure and collar/ring are assembled (FIG. 12) to form what is known as a child resistant safety container.

The collar/ring (19) is rotatably coupled to the container body (17) so as to not be removable from the container body. The closure/cap is removably coupled to the collar/ring. As described in more detail hereafter, the closure is only removable from the collar/ring when the closure is aligned in a certain position relative to the ring. A marking can exist on the ring and closure to indicate proper alignment.

When the safety container is closed, the closure and ring are interconnected so that they rotate as a single unit around the container body. The unison rotation frustrates accidental alignment of the closure and ring. A user can prevent unison rotation of the closure and ring by simply holding the ring and rotating the closure relative to the ring or vice versa.

Figure 2:
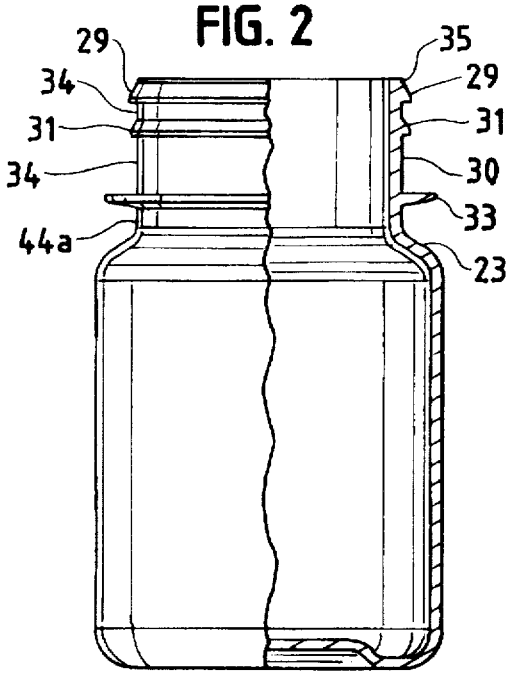
FIG. 2 is a side view of one embodiment of my invention; the view looks into the side of the container body, half of the container body being sectioned along its vertical plane.
Figure 3:
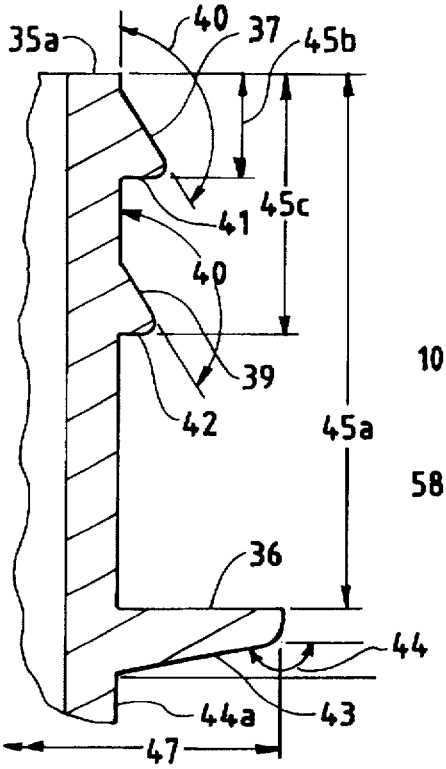
FIG. 3 is a close-up sectional view of a portion of the neck of the container body; the cross section is taken along the neck portion's vertical plane.
Figure 4:
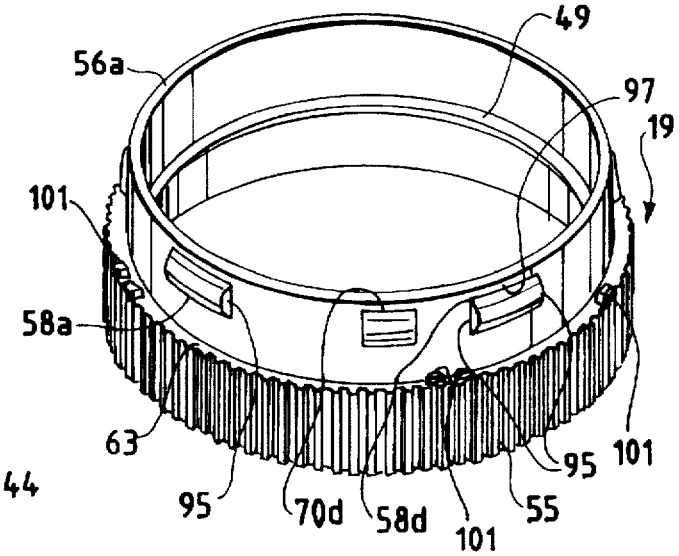
FIG. 4 is a top side perspective view of the ring.
Figure 5:
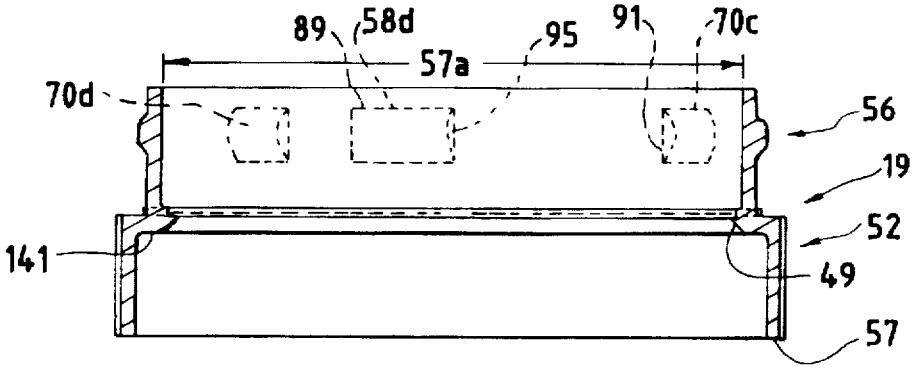
FIG. 5 is a side view of the ring; the ring has been sectioned at opposite sides along its vertical plane.

Now referring to FIGS. 1–3, the container body (17) has a curved shoulder portion (23) and a cylindrical coupling portion (25) extending upwardly from the shoulder (23). The coupling portion (25) can alternatively be referred to as a cylindrical neck (25). The container also includes an open end (27) at the top end of the neck or at the container's vertical top. The container has a closed end opposite the open end.

The neck has a first annular neck protrusion (29) adjacent to the open end (27). Below the first annular neck protrusion and axially spaced therefrom is a first annular guide protrusion (31) and a lower second annular guide protrusion (33). The guide protrusions (31, 33) define an annular guide groove (30). The first guide protrusion, the second guide protrusion and the annular groove form a guide or means for rotatably coupling the container body to the ring. Each of the neck and guide protrusions extends radially outward from the outer surface (34) of the neck (25). Each of the protrusions forms an unbroken band around the neck's outer cylindrical surface (34). Each of the protrusions or bands (29, 31, 33) has a top surface facing the open end (27) and a bottom surface facing the shoulder (23).

Referring to FIG. 3, the second guide protrusion has a top surface (36) that is flat and is perpendicular to the vertical axis of the neck. The neck protrusion (29) and first guide protrusion (31) have top surfaces, (37) and (39) respectively, which are frustoconical and downwardly sloped. The frustoconical surfaces each form an angle (40) with the neck's outer surface, the angle being from about 135° to about 165°, and preferably about 150°. The portion of the neck's outer surface (35) above the neck protrusion (29) is the same diameter as surface (34). The container top (35*a*) is sized to provide a seal with a cap and seal as hereinafter described.

Both the neck protrusion (29) and first guide protrusion (31) have annular bottom surfaces (41) and (42) respectively. These bottom surfaces are flat and perpendicular to the vertical axis of the neck. The second guide protrusion (33) has a frustoconical bottom surface (43) which slopes up towards the open end. The second guide's frustoconical surface forms an angle (44) from about 165° to 175°, and preferably 170° with a plane perpendicular to the neck's vertical axis. The neck's outer surface extends between the second guide (33) and the container's shoulder (23) to provide a lower cylindrical surface (44*a*).

The vertical axial distance (45*a*) from the top of the container to the second guide protrusion's top surface is from about 0.640 to about 0.650; preferably from about 5.1 to 5.2 times greater than the vertical axial distance (45*b*) from the top of the container to the neck protrusion's bottom surface. The vertical axial distance (45*a*) is from about 0.640 to about 0.650; preferably about 2.0 to 2.1 times greater than the vertical axial distance (45*c*) from the top (27) of the container to the first guide protrusion's bottom surface (42).

The second guide's outer diameter (47) is about 1.1 to 1.3 times greater than the first guide's outer diameter, and about 1.09 to about 1.25 times greater than the neck protrusion's outer diameter. The neck protrusion's outer diameter is equal to or preferably slightly greater than the first guide's outer diameter.

Referring to FIGS. 4–7*c*, the collar or ring has a lower cylindrical portion or lower ring (52), with a contoured outer vertical surface. The contours in the shown embodiment form ribs (55) for ease of gripping the ring. The ring has a cylindrical upper ring portion (56), which has an outer diameter smaller than the outer diameter of the lower ring portion (52). The axial length of the lower ring portion is substantially equal to the axial length of the upper ring portion. The ring has a vertical axial length about 0.95 times the vertical axial length (45*a*). The upper ring portion extends concentrically upward from the lower ring portion to provide an annular upper ledge surface (63) at the top of the lower ring portion and the bottom of the upper ring portion. When the ring rests on the second guide collar, the ring's top surface (56*a*) and the neck protrusion's frustum apex are both in about the same horizontal plane.

When the ring is coupled to the container body (FIG. 12), a complete circumferential path formed along the upper ring's inner surface contacts the neck protrusion and another complete circumferential path formed along the upper ring's inner surface contacts the first guide protrusion. The upper ring's inner diameter is about equal to the neck protrusion's outer diameter and about equal to the first guide's outer diameter. The lower ring's outer diameter is slightly smaller than the second guide collar's outer diameter.

The ring (19) has an annular inner support (49). The support extends radially inward from the inner surface of the ring. The support traverses an unbroken circumferential path around the inner cylindrical surface of the ring. The support has a top flat annular surface or shoulder (51) which faces the ring's top. The support's top flat annular surface is perpendicular to the ring's vertical axis. A frustoconical bottom surface (53) diverges from the open end of the shoulder (51) and forms an angle (54) of about 120° to 170°, preferably 135° with a vertical plane parallel to the ring's vertical axis. The support has an inner cylindrical side surface (53*a*) parallel to the ring's vertical axis that extends downwardly from the open end of the flat surface (51).

The ring's support rotatably couples to the container body's guide. The support ensures that the ring does not move too far up along the neck's axis in the direction of the open end. The bottom surface of the ring (57) rests on the second guide. The bottom surface ensures the ring does not move too far down along the neck's axis in the direction of the closed end. The ring's support and the ring's bottom surface thus help to provide a means for rotatably coupling the ring to the container body.

An annular ring protrusion is circumferentially arranged around the upper ring's outer surface. The protrusion is divided into a group of four first annular segments (58*a*, 58*b*, 58*c* and 58*d*). The first segments are circumferentially arranged around the upper ring's outer vertical surface. The first segments (58) all substantially lie in a same circumferential plane which is substantially perpendicular to the ring's vertical axis.

The ring protrusion is further divided into a group of four second annular segments (70*a*, 70*b*, 70*c* and 70*d*). The second segments are circumferentially arranged around the upper ring's outer surface so that there is one second ring segment between each adjacent pair of first ring segments. The second ring protrusion segments all substantially lie in a same circumferential plane which is substantially perpendicular to the vertical axis of the ring. The axial length of the first segments of the ring protrusion are substantially equal to the axial length of the second segments of the ring protrusion, and both the first and second ring protrusion segments lie substantially in the same circumferential plane.

Figure 7:
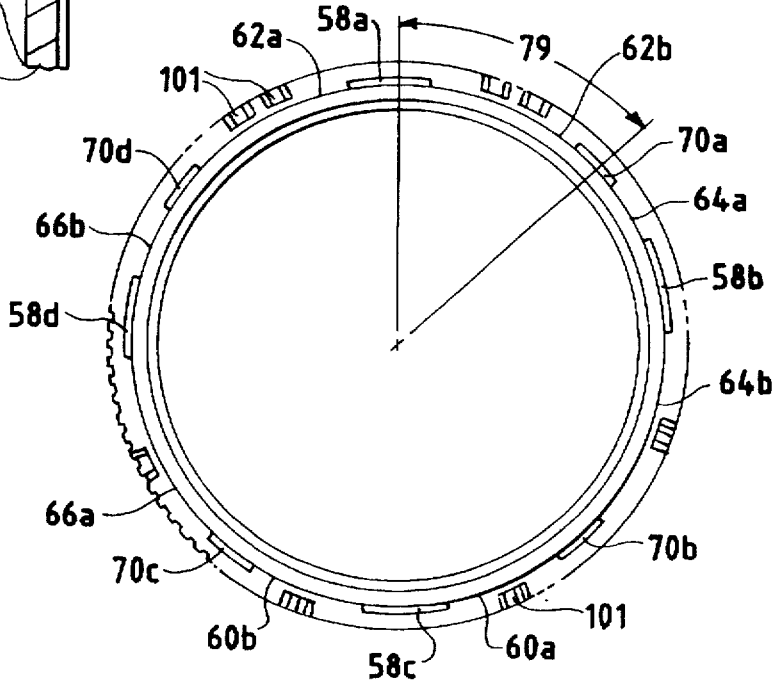
FIG. 7 is a top perspective view looking down into the ring.

Referring to FIG. 7, the ring protrusion segments are spaced apart a predetermined distance. For instance, two first segments of the ring protrusion (58*a* and 58*c*) are diametrically opposite each other. Two second segments of the ring protrusion (70*a* and 70*d*) are on opposite arcuate ends of the first segment (58*a*) and their centers are equally circumferentially spaced from the center of the first segment (58*c*). Two second segments of the ring protrusion (70*b* and 70*c*) are on opposite arcuate ends of the first ring protrusion segment (58*c*) and their centers are equally circumferentially spaced from the center of the first ring protrusion segment (58*c*). The spacing between first ring protrusion segment (58*a*) and second ring protrusion segment (70*a*) is greater than the spacing between first ring protrusion segment (58*c*) and second ring protrusion segment (70*c*).

The circumferential spacing between first protrusion segments (58*a* and 58*b*) is equal to the circumferential spacing between first protrusion segments (58*a* and 58*d*). The circumferential spacing between first ring protrusion segments (58*b* and 58*c*) is equal to the circumferential spacing between first ring protrusion segments (58*c* and 58*d*). The circumferential spacing between first ring protrusion segments (58*b* and 58*c*) is greater than the circumferential spacing between first ring protrusion segments (58*a* and 58*b*). The arcuate length of each of the first ring protrusion segments (58*a*, 58*b*, 58*c* and 58*d*) is approximately 15° to 20° and the arcuate length of each of the second ring protrusion segments (70*a*, 70*b*, 70*c* and 70*d*) is approximately 8° to 10°.

Each ring protrusion segment has an arcuate center. The arc length from the arcuate center of a segment to the arcuate center of an adjacent segment is a center-to-center arc (79). There are a total of eight center-to-center arcs and a total of four pairs of center-to-center arcs. Each pair of center arcs is exclusive of the center arcs of each other pair of center arcs.

Figure 7A:
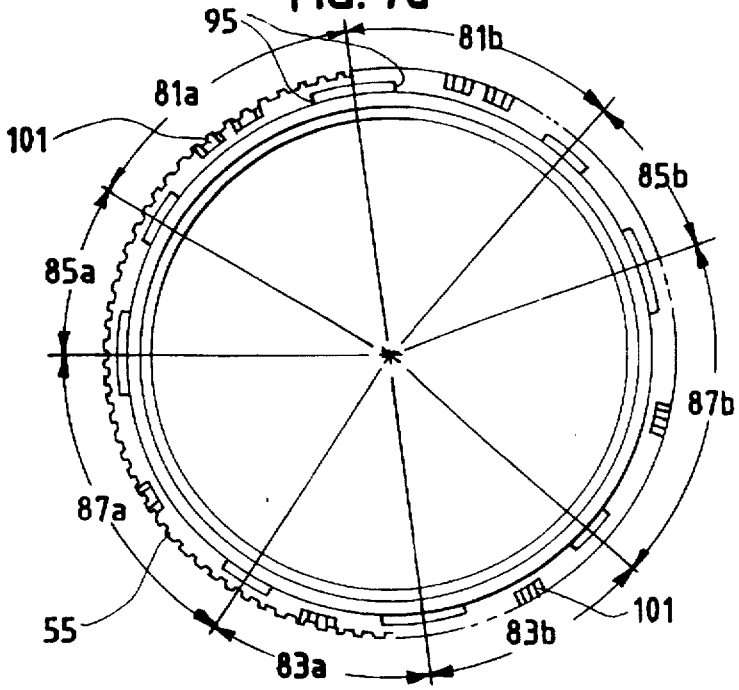
FIG. 7*a* is a top perspective view looking down into the ring.

Referring to FIG. 7*a*, a first pair of center-to-center arcs (81*a* and 81*b*) having the same arc length are adjacent to each other. A second pair of center-to-center arcs (83*a* and 83*b*) having the same arc length are adjacent.

A third pair of center-to-center arcs (85*a* and 85*b*) having the same arc length are not adjacent to each other. A fourth pair of center-to-center arcs (87*a* and 87*b*) having different arc lengths are not adjacent to each other.

The center arcs making up the first pair having the same arc length each have a center-to-center arc of 50°. The center arcs making up the second pair having the same arc length each have a center-to-center arc of 40°.

The center arcs making up the third pair each have arcs of 30°. The center arcs making up the fourth pair each have arcs of 60°.

Each of the eight arcs is formed from a first and second ring protrusion segment, i.e., 58*a* and 70*a*, 58*a* and 70*b*, etc.

The circumferential arrangement of the protrusion segments of the ring can also be described by considering the gaps or breaks dividing the ring protrusion into segments. Each pair of adjacent segments is separated by a gap. Every gap or break in the protrusion divides the protrusion into a segment. Thus a protrusion having one gap can be referred to as a segment.

There are a total of four pairs of gaps, i.e., the protrusion has eight gaps. Each pair of gaps is exclusive of each other pair. There is a first pair of gaps (60*a* and 60*b*) having the same arc length. These gaps are adjacent. There is a second pair of gaps (62*a* and 62*b*) having the same arc length. These gaps are also adjacent.

There is a first pair of gaps having different arc lengths. (64*a* and 64*b*). These gaps are adjacent. There is a second pair of gaps each having different arc lengths (66*a* and 66*b*). These gaps are adjacent.

The segments forming the ring protrusion (58, 70) each have a trapezoidal-like shape. Each segment has a top surface (89) facing the ring's top surface, a bottom surface (91) facing the bottom of the ring, a cylindrical side surface (93) parallel to the ring's vertical axis and facing outward, and two end surfaces (95). The top surface of each segment is frustoconical, downwardly sloping from the ring's outer surface towards the side surface (93). The top frustoconical surface forms an angle (94*a*) of about 120° to 150°, preferably 135° with the ring's outer surface (97). The bottom surface of each segment is frustoconical, and slopes upward from the ring's outer surface to the side surface. The bottom frustoconical surface forms an angle (94*b*) of about 120° to 150°, preferably 135° with the ring's outer surface.

The end surfaces of each segment preferably converge from the ring's outer surface towards their respective segments' arcuate centers.

In the shown embodiment, the segments come in two different arc lengths. The segments (58) having the longer arc length have an arc length of about 0.16 to 0.18 times the upper ring's inner diameter, preferably 0.17 times. The segments having the longer arc length (58) are about 1.66 to 1.77 times arcuately longer than the shorter arc length segments (70), preferably about 1.72 times larger.

The ring's top surface is axially above the top of the ring protrusions (58) to provide a cylindrical surface axially separating the ring's top surface (56*a*) and the top surface of the ring protrusions (58).

The ring's support has a vertical axis which only extends its axial length. The ring's protrusion has a vertical axis which only extends its axial length. The ring protrusion's vertical axis can be enclosed in a horizontal plane perpendicular to the ring protrusion's vertical axis. The ring support's vertical axis can be enclosed in a horizontal plane perpendicular to the ring support's vertical axis. The plane enclosing the support's vertical axis and the plane enclosing the protrusion's vertical axis do not intersect and are at different vertical heights.

The ring's annular upper ledge surface (63) has a plurality of protruding teeth (101). The teeth (101) could be ribs, grooves or the equivalent, and are herein collectively referred to as key protrusions.

The arrangement of teeth can be described in the following manner. Two teeth are between the first segment (58*a*) and the second segment (70*a*). Two teeth are between the first segment (58*a*) and the second segment (70*d*). There is a tooth between: first protrusion 58*d* and second protrusion 70*c*; first protrusion 58*c* and second protrusion 70*c*; first protrusion 58*c* and second protrusion 70*b*; and first protrusion 58*b* and second protrusion 70*b*. In addition, not more than 80° of the ring's cylindrical perimeter is without at least a portion of a tooth. The teeth are also arranged so that two portions of teeth are diametrically opposite each other.

Figure 7B:
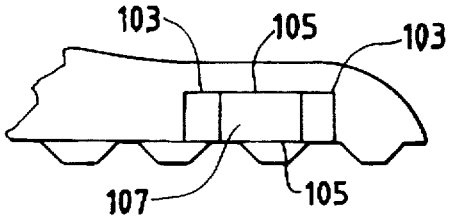
FIG. 7*b* is a close-up top perspective view of the ring looking down into the ring's annular upper ledge surface; the view includes a top perspective view of a tooth disposed on the ledge.
Figure 7C:
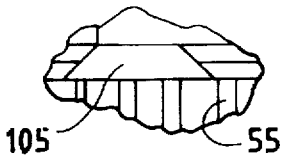
FIG. 7*c* is a close-up side perspective view looking at the side of the ring at the axial height of the ring's annular upper ledge surface; the view includes a side view of a tooth disposed on the ledge.
Figure 8:
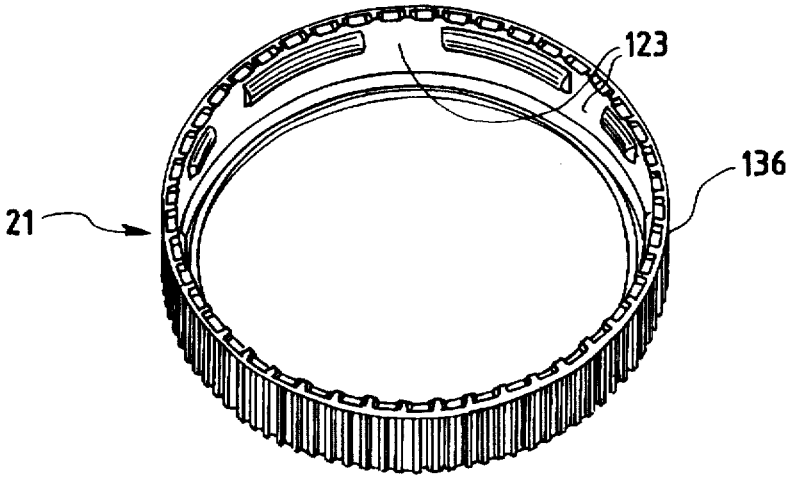
FIG. 8 is a bottom side perspective view of the closure looking into the closure's open end.
Figure 9:
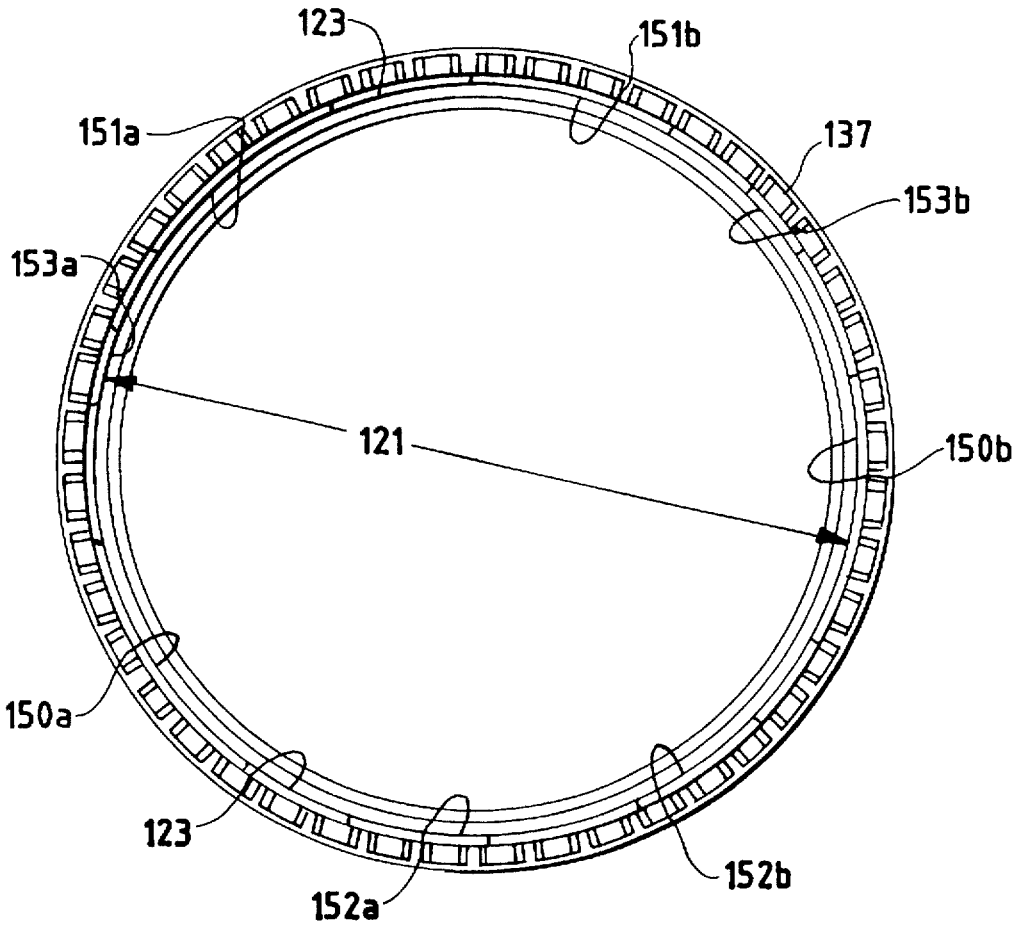
FIG. 9 is a bottom perspective view of the closure looking into the closure's open end.

The teeth (101), as shown (FIG. 7*b*, FIG. 7*c*), each have a trapezoidal shape with converging end surfaces (103) having a base angle of about 135° with the upper ledge surface. The side surfaces of each tooth (105) are substantially parallel to the ring's vertical axis. The top surface of each tooth (107) is perpendicular to the ring's vertical axis. The top surface of each tooth has an arcuate length greater than the radial length of the tooth. The axial length of each tooth is substantially equal to the axial length of the ring support's side surface.

Figure 6:
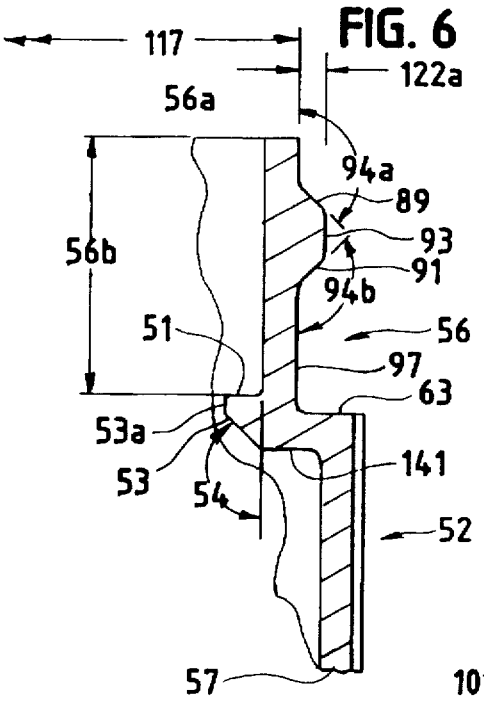
FIG. 6 is a close-up view of the right side portion of the ring shown in FIG. 5.

Referring to FIGS. 8–11, the closure or cap (21) comprises a top surface (109), a cylindrical side wall (111), an inner sealing ring (113), an annular closure protrusion, and an open end opposite the top surface. The wall (111) has an inner diameter (116) about equal to the ring protrusion's outer diameter (117) (FIG. 6).

The inner sealing ring (113) extends axially and vertically downward from the top. The sealing ring (113) holds sealing material (119) (FIG. 12) to form a compression seal.

The annular protrusion extends radially inward from the inner surface of the cap's wall. The protrusion traverses a path along the inner circumferential surface of the cap's wall. The cap's protrusion forms an innermost diameter (121) about equal to the diameter of the upper ring's outer surface (97).

The closure protrusion is divided into a plurality of segments. Each adjacent pair of segments is separated by a gap or break (123). The segments are sized and spaced to axially pass between the gaps in the ring's protrusion (58) when the closure is properly positioned for removal from the ring.

There are four pairs of closure segments. Each of the segments of the first pair (150*a*, 150*b*) have the largest arcuate length. In the preferred embodiment each closure segment of the first pair is about more than twice the arcuate length of each of the first ring segments (58). Each of the second pair of closure segments (151*a*, 151*b*) has an arcuate length slightly greater than 75% of the arcuate length of each closure segment of the first pair (150*a*, 150*b*).

Preferably each of the third pair of closure segments (152*a*, 152*b*) is smaller than each of the second pair of closure segments. The third pair of closure segments (152*a*, 152*b*) each has an arcuate length slightly greater than 50% of the arcuate length of each of the first pair of closure segments (150*a*, 150*b*). Each of the third pair of closure segments is larger than each of the first ring segments (58).

Preferably each of the fourth pair of closure segments (153*a*, 153*b*) has an arcuate length slightly greater than 25% of the arcuate length of each of the first pair (150*a*, 150*b*) of closure segments. Each of the fourth closure segments (153*a*, 153*b*) has substantially the same arcuate length as the second ring segments (70). The pairs of closure segments (150–153) each have substantially the same width or radial length. Their radial length (122) is the same as the radial length or width (122*a*) (FIG. 6) of the ring segments (58 and 70).

Each closure segment forms a sort of trapezoidal shape. Each closure segment has a top surface (129) facing the closure's top, a bottom surface (131) facing the open end of the closure, and an annular side surface (133) parallel to the closure's vertical axis and facing inward. The top surface of each closure segment is frustoconical and slopes downward from the inner closure wall towards the closure's open end and to the side surface (133). The top frustoconical surface forms an angle (132) of about 120° to about 150°, and preferably 135° with the closure wall's inner surface. The bottom surface of each segment is frustoconical and slopes upward from the inner closure wall towards the top (109) and to the side surface (133). The bottom frustoconical surface forms an angle (134) of about 120° to about 150°, preferably 135° with the closure wall's inner surface. Each segment has end surfaces (135). The end surfaces converge inward towards their respective segments' arcuate centers. The end surfaces form an angle (135*a*) of about 30° to 45° with the segments' arcuate centers.

The closure's segments have a particular sizing and spacing. Each segment is sized and spaced so that upon removal of the closure from the ring each closure segment can be aligned to pass through a different gap in the ring's protrusion; and each gap in the closure protrusion will allow passage of a different ring segment.

The entire structure of the closure's segments is axially spaced a predetermined distance above an annular end wall (136) which defines the closure open end. The annular end wall forms the bottom surface of the cap's wall.

The annular end wall (136) has a plurality of arcuate trapezoidal key grooves (137) formed therein. The key grooves or indentations (137) have a shape which complements the ring's teeth. The arcuate trapezoidal grooves (137) are preferably equally spaced from each other around the entire end wall (136) and are slightly larger than the ring's teeth. By having the grooves about the entire end wall (136), the grooves and teeth can be engaged at numerous positions.

Figure 12:
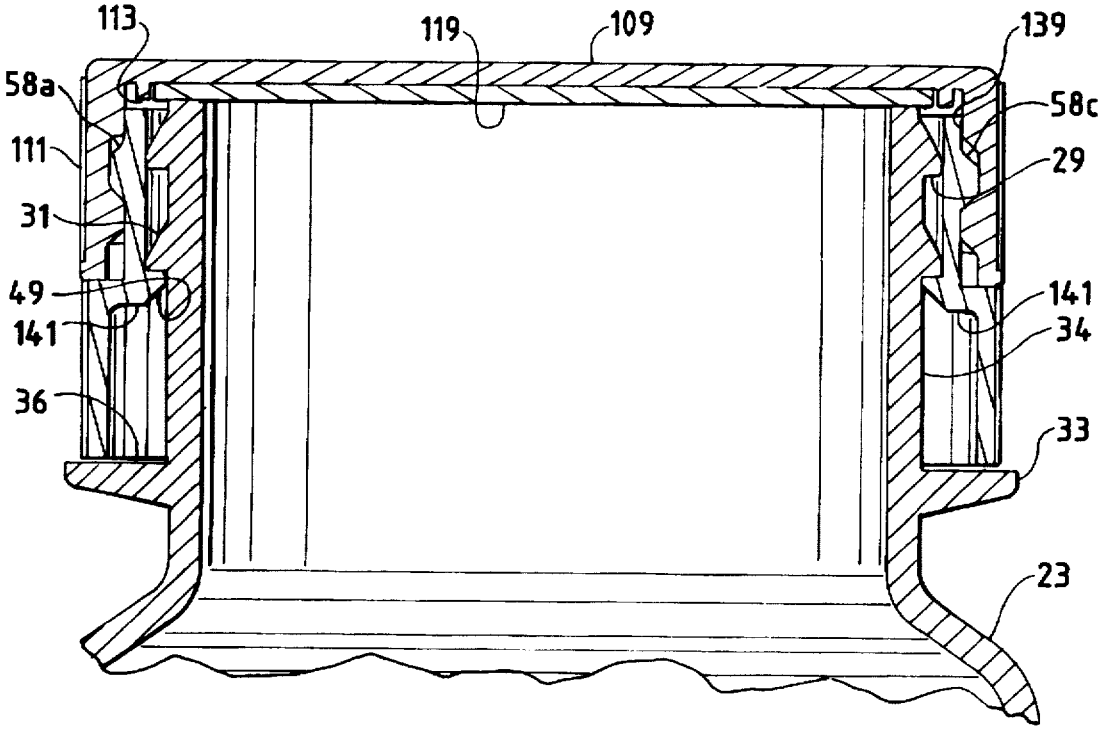
FIG. 12 is a close-up sectional view of my invention showing the ring coupled to the container body and the closure coupled to the ring, the section being taken along a vertical plane passing through a diameter of the ring.

The wall of the cap extends vertically downward so that the teeth and indentations will interlock when the container is closed (FIG. 12). The size of the teeth and grooves and interlocking nature of both are such that when either the cap or ring is turned both the cap and ring will turn. However, when either of the cap or ring is held and the other of the cap or ring is rotated, the cap and ring will rotate relative to one another.

Figure 10:
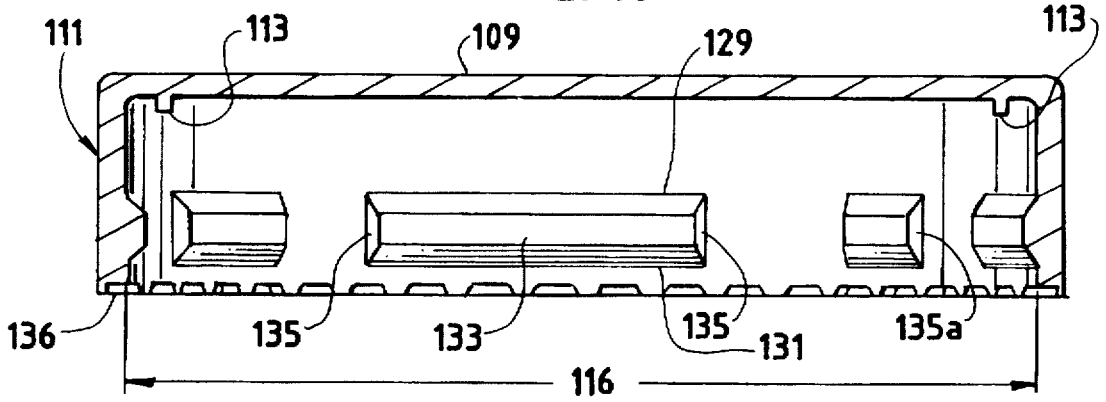
FIG. 10 is a side cross sectional view of the closure, the section being taken along a diameter of the closure.
Figure 11:
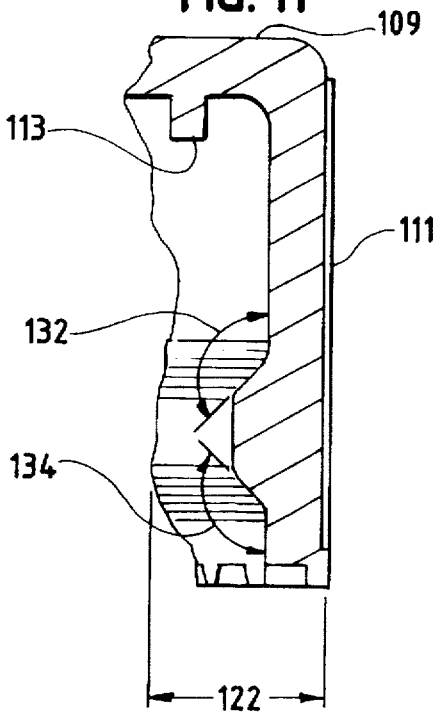
FIG. 11 is a close-up view of the right side of the sectioned closure shown in FIG. 10.

As an alternative to what is shown in FIGS. 10 and 11, in FIG. 12 an upper interior portion (139) of the cap's side wall (111) is wider so that it contacts the upper ring's outer vertical surface, the contact taking place vertically above the ring protrusions (58, 70).

The container can be made from numerous materials including plastics such as polyethylene. The ring and cap are also preferably made from plastic type material.

When referring to FIG. 12, the ring (19) is slid over the neck and snaps onto the container body (17). The insertion of the ring is aided by the sloped surfaces of the neck protrusion (29), the first guide (31) and the ring support (49). The opposing horizontal surfaces of these structures, however, prevent easy removal of the ring.

The ring's support (49) protrudes underneath the container's first guide (31) when the ring is coupled to the container body. The ring's support prevents the ring from sliding axially above the container body's open end. The second guide (33) provides a horizontal support for the ring when the ring is coupled to the container body and when the cap is detached from the ring. The second guide, first guide and guide groove form a guide or a means for rotatably coupling the ring to the container body.

A slight gap exists between the ring's support and the first guide when the ring rests on the second guide. This gap is generally the height of the ring teeth (101). As shown in FIG. 12, the ring support bottom surface (141) and the container guide top surface (36) remain free of contact when the container is in its closed position after coupling of the container body, the ring and closure. This cuts down on the friction between the ring and container body enhancing unison rotation of the ring and cap.

A coupled cap and ring can be positioned relative to each other so that upon removal of the cap from the ring each of the cap's protrusion segments will pass through a different one of the gaps in the ring's protrusion; and each of the gaps in the cap's protrusion will allow the passage of a different one of the ring's protrusion segments. Each gap thus complements a segment and vice versa.

The cap can be coupled to the ring without complementary alignment of the gaps and segments. The flexibility of the cap and the shape and spacing of the segments allow the non-complementary coupling. The downward force on the top of the cap is sufficient to flex the cap's side wall and to snap the cap onto the ring. However, the shape and spacing of the closure segments and the ring segments prevent removal of the cap from the ring, unless the gaps and segments have a complementary alignment.

The cap, when locked in place on the ring, supports the ring axially upward so that the ring does not rest on the second guide; a slight space exists between the ring and the second guide. The cap segments fit snugly beneath the ring's segments when the cap is locked in place on the ring, i.e., the gaps and segments are not aligned.

Frictional forces exist between the cap's protrusion and the ring's outer vertical surface; between the ring's protrusion and the cap wall's inner surface; between the cap's and ring's protrusions; and between the teeth and indentations. These frictional forces are greater than the frictional forces between the seal (119) and the container top and between the container protrusions and the inner surfaces of the ring. Thus the cap and ring will rotate in unison. The unison rotation impedes accidental alignment of the cap and ring. The frictional forces, however, are weak enough that one can rotate the cap relative to the ring by holding the cap or ring steady.

The neck protrusion provides a horizontal outward force to oppose the ring's horizontal inward force caused during improper removal of the cap from the ring. The neck protrusion thus inhibits an unwanted collapsing of the ring.

The second guide (33) inhibits one from inserting an object between the container and the ring's bottom surface (57) to pry the ring off the container.

It will, of course, be appreciated that the above-described embodiments of the invention are merely examples, and the invention is not limited to the examples described herein. Obviously, numerous modifications and variations of the present invention are possible in light of the above features. It is therefore understood that various changes and modifications may be effected by one skilled in the art without departing from the scope or spirit of the invention as defined in the appended claims.

What is claimed is:

1. A child resistant container comprising:

a container body wherein said container body has a means to rotatably couple a ring to said container body; said container body has a guide which forms part of the container body's rotatable means;

a ring, said ring having a means for rotatably coupling itself to said container body;

a support forming part of said ring's rotatable means, said support traversing a path along an inner surface of said ring a protrusion disposed on an outer surface of said ring to form a ring protrusion, said ring protrusion traversing a path along the outer surface of said ring, said ring protrusion has a plurality of gaps therein, wherein each gap in said ring protrusion divides the protrusion into segments;

a closure, said closure sized to be coupled to said ring, said closure having a protrusion, said protrusion traversing a path along an inner surface of said closure to form a closure protrusion, said closure protrusion has a plurality of gaps therein, wherein each gap in said closure protrusion divides the protrusion into segments;

a first pair of gaps from said plurality of gaps in said ring protrusion, said first pair of gaps having a same arc length and being adjacent to each other;

a first pair of gaps in said ring protrusion having different arc lengths, said first pair of gaps in said ring protrusion having different arc lengths being adjacent to each other, said first pair of gaps in said ring protrusion having the same arc length being exclusive of said first pair of gaps in sail ring protrusion having different arc lengths;

an amount of segments disposed on said closure equal in number to an amount of gaps in said ring protrusion;

an amount of gaps in said closure protrusion equal in number to an amount of segments disposed on said ring;

said closure and said ring, when coupled, having a position relative to one another so that upon uncoupling of the closure from the ring each segment of said amount of segments disposed on said closure will pass through a different one of said amount of gaps in said ring protrusion, and each gap of said amount of gaps in said closure protrusion will allow passage of a different one of said amount of segments disposed on said ring.

2. The child resistant container of claim 1 wherein said plurality of gaps in said ring protrusion comprises: a second pair of gaps having a same arc length, said second pair having the same arc length being adjacent to each other, said second pair of gaps having the same arc length being exclusive from said first pair of gaps having the same arc length.

3. The child resistant container of claim 1 wherein said plurality of gaps in said ring protrusion comprises a second pair of gaps having different arc lengths, said second pair having different arc lengths being adjacent, said first pair of gaps of different arc lengths being exclusive of said second pair of gaps of different arc lengths.

4. The child resistant container of claim 1 wherein said plurality of gaps comprise at least four different arc lengths.

5. The child resistant container of claim 1 wherein said amount of gaps disposed on said ring have a combined arc length of between 225° and 235°.

6. The child resistant container of claim 1 wherein said amount of segments disposed on said ring have a combined arc length of between 110° and 120°.

7. A child resistant container comprising:

a container body wherein said container body has a means to rotatably couple a ring to said container body: said container body has a guide which forms part of the container body's rotatable means;

a ring, said ring having a means for rotatably coupling itself to said container body;

a support forming part of said ring's rotatable means, said support traversing a path along an inner surface of said ring;

a protrusion disposed on an outer surface of said ring to form a ring protrusion, said ring protrusion traversing a path along the outer surface of said ring, said ring protrusion has a plurality of gaps therein, wherein each gap in said ring protrusion divides the protrusion into segments;

a closure, said closure sized to be coupled to said ring said closure having a protrusion, said protrusion traversing a path along an inner surface of said closure to form a closure protrusion, said closure protrusion has a plurality of gaps therein, wherein each gap in said closure protrusion divides the protrusion into segments;

a first pair of gaps from said plurality of gaps in said ring protrusion, said first pair of gaps having a same arc length and being adjacent to each other;

a second pair of gaps from said plurality of gaps in said ring protrusion having the same arc length, said second pair of gaps being adjacent to each other, said second pair of gaps having the same arc length exclusive of said first pair of gaps having the same arc length;

an amount of segments disposed on said closure equal in number to an amount of gaps in said ring protrusion;

an amount of gaps in said closure protrusion equal in number to an amount of segments disposed on said ring;

a first pair of gaps from said plurality of gaps in said ring protrusion having different arc lengths, said first pair of gaps having different arc lengths being adjacent to each other, said first pair of gaps having different arc lengths being exclusive of both of said first pair and second pair of gaps having the same arc length;

said closure and said ring, when coupled, having a position relative to one another so that upon uncoupling of the closure from the ring each segment of said amount of segments disposed on said closure will pass through a different one of said amount of gaps in said ring protrusion, and each gap of said amount of gaps in said closure protrusion will allow passage of a different one of said amount of segments disposed on said ring.

8. A child resistant container comprising:

a container body wherein said container body has a means to rotatably couple a ring to said container body; said container body has a guide which forms part of the container body's rotatable means;

a ring, said ring having a means for rotatably coupling itself to said container body;

a support forming part of said rings rotatable means, said support traversing a path along inner surface of said ring;

a protrusion disposed on an outer surface of said ring, said protrusion traversing a path along the outer surface of said ring, said protrusion has a plurality of gaps therein, wherein each gap in said protrusion divides the protrusion into segments;

a closure, said closure sized to be coupled to said ring, said closure having a protrusion, said protrusion traversing a path along an inner surface of said closure, said rotation has a plurality of gaps therein, wherein each gap in said closure protrusion divides the protrusion into segments;

an amount of segments disposed on said closure equal in number to an amount of gaps in said ring protrusion;

an amount of gaps in said closure protrusion equal in number to an amount of segments disposed on said ring;

a plurality of segments on said ring wherein each segment of said plurality has an arcuate center:

an arc length measured from the arcuate center of a segment of said plurality to the arcuate center of an adjacent segment of said plurality, said arc length measured being a center-to-center arc, a plurality of center-to-center arcs on said ring;

a first pair of center-to-center arcs from said plurality having a same arc length, said first pair being adjacent to each other:

a second pair of center-to-center arcs from said plurality having a same arc length, said second pair of center-to-center arcs having the same arc length not being adjacent to each other, said first pair of center-to-center arcs being exclusive of said second pair of center-to-center arcs, said first pair of center-to-center arcs each having a different length from said second pair;

said closure and said ring, when coupled, having a position relative to one another so that upon uncoupling of the closure from the ring each segment of said amount of segments disposed on said closure will pass through a different one of said amount of gaps in said ring protrusion, and each can of said amount of caps in said closure protrusion will allow passage of a different one of said amount of segments disposed on said ring.

9. The child resistant container of claim 8 wherein said plurality of center-to-center arcs on said ring comprises: a third pair of center-to-center arcs, said third pair being exclusive of said first and second pair, and said third pair of center-to-center arcs each having a different arc length from said first and second pairs.

10. The child resistant container of claim 8 wherein said plurality of center-to-center arcs has at least four different arc lengths.

* * * * *

UNITED STATES PATENT AND TRADEMARK OFFICE

CERTIFICATE OF CORRECTION

PATENT NO. : 5,791,504
DATED : August 11, 1998
INVENTOR(S) : Richard W. Hofmann & Alex J. Kutaj It is certified that error appears in the above-indentified patent and that said Letters Patent is hereby corrected as shown below:

Column 2, Line 18, begin new paragraph with --The closure has...--
Column 11, Line 37, delete "sail" and insert --said--
Column 13, Line 9, delete "rotation" and insert --protrusion--
Column 14, Line 14, delete "can" and insert --gap--
Column 14, Line 14, delete "caps" and insert --gaps--

Signed and Sealed this

Fifteenth Day of December, 1998

*Attest:*

BRUCE LEHMAN

*Attesting Officer*

*Commissioner of Patents and Trademarks*